US007717833B1

(12) United States Patent
Nelson et al.

(10) Patent No.: US 7,717,833 B1
(45) Date of Patent: May 18, 2010

(54) ADJUSTABLE, REVERSIBLE EXERCISE APPARATUS WITH CONVERGING AND DIVERGING MOTION

(75) Inventors: Westin W. Nelson, Dayton, MN (US); Lee M. Atwood, Andover, MN (US); Aaron J. Miller, Brooklyn Center, MN (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 12/179,687

(22) Filed: Jul. 25, 2008

(51) Int. Cl.
*A63B 21/062* (2006.01)
*A63B 23/035* (2006.01)

(52) U.S. Cl. ..... 482/100; 482/137; 482/138

(58) Field of Classification Search ..... 482/92, 482/93, 97–100, 133–138, 142
See application file for complete search history.

(56) References Cited

U.S. PATENT DOCUMENTS 4,125,258 A * 11/1978 McArthur ..... 482/100
4,898,381 A * 2/1990 Gordon ..... 482/103
5,152,733 A * 10/1992 Farenholtz et al. ..... 482/135
5,419,751 A * 5/1995 Byrd et al. ..... 482/138
5,447,480 A * 9/1995 Fulks ..... 482/99
5,518,477 A * 5/1996 Simonson ..... 482/102
5,554,085 A * 9/1996 Dalebout ..... 482/137
5,741,205 A 4/1998 Doll et al.
5,885,193 A * 3/1999 Habing et al. ..... 482/92
6,090,020 A * 7/2000 Webber ..... 482/100
6,162,153 A * 12/2000 Perez et al. ..... 482/96
6,302,833 B1 * 10/2001 Ellis et al. ..... 482/100
6,527,683 B2 3/2003 Tolles
6,689,023 B2 2/2004 Baumler
6,824,505 B1 * 11/2004 Chang ..... 482/95
7,101,327 B1 9/2006 Baumler et al.
7,195,584 B1 3/2007 Lu et al.
7,223,213 B2 5/2007 Golesh
7,282,015 B1 10/2007 White
7,377,887 B1 5/2008 Rosenow et al.
2007/0155597 A1 7/2007 Hockemeyer
2007/0161472 A1 * 7/2007 Drechsler ..... 482/100

FOREIGN PATENT DOCUMENTS

AT 397619 B * 4/1994
TW 317755 * 10/1997
WO WO 2005002680 A2 * 1/2005

* cited by examiner

*Primary Examiner*—Loan H Thanh
*Assistant Examiner*—Victor K Hwang
(74) *Attorney, Agent, or Firm*—Andrus, Sceales, Starke & Sawall, LLP

(57) ABSTRACT

Disclosed are adjustable exercise machines, apparatuses, and systems. The disclosed machines, apparatuses, and systems typically include an adjustable, reversible mechanism that utilizes pivoting arms and a floating pulley. The disclosed machines, apparatuses, and systems typically are configured for performing pushing and pulling exercises and may provide for converging and diverging motion.

25 Claims, 14 Drawing Sheets

ADJUSTABLE, REVERSIBLE EXERCISE APPARATUS WITH CONVERGING AND DIVERGING MOTION

BACKGROUND

The field of the invention relates to exercise machines and apparatuses for strength training that utilize resistance mechanisms.

Exercise machines and apparatuses are known in the art including those that utilize resistance mechanisms such as a weight stack and a pulley system. A typical exercise machine includes a frame, a resistance mechanism mounted on the frame, and one or more exercise outlets that are functionally connected to the weight stack. Pulleys and cables are commonly used to functionally connect the weight stack to the exercise outlets.

Many exercise machines are designed for use in areas that are either multipurpose or smaller than a traditional gymnasium, for example, a home, apartment, or hotel room. These area restrictions make it increasingly important to conserve space by reducing the size of the exercise machines as well as incorporating multiple functions into one machine. Providing an exercise machine that allows an exerciser to perform different exercise movements using a single resistance mechanism therefore is desirable. Furthermore, adjustable exercise machines and apparatuses are desirable.

SUMMARY

Disclosed are exercise machines, apparatuses, systems, as well as methods for making and using the disclosed exercise machines, apparatuses, systems. The disclosed machines, apparatuses, and systems typically include an adjustable, reversible mechanism which may be configured to provide for converging and diverging motion.

The disclosed exercise apparatuses may include: (a) first and second arms that rotate about a common rotational axis, the first and second arms having a fixed orientation with respect to each other; (b) a resistance mechanism (e.g., a weight stack); (c) a fixed pulley; (d) a cable extending through the fixed pulley and coupling the second arm to the resistance mechanism; (e) a floating pulley engaging the cable; (f) a docking device for docking the floating pulley; and (g) an engaging device that is coupled to the second arm at a location distal from the rotational axis. As the first and second arms are rotated about the rotational axis in one direction, the engaging device engages the floating pulley and the second arm pulls the cable against the resistance mechanism. As the first and second arms are rotated about the rotational axis in the opposite direction, the docking device docks the floating pulley and the second arm pulls the cable against the resistance mechanism. The first arm alternatively may be referred to as a work arm or a press arm. The second arm alternatively may include a cam and may be referred to as a cam arm.

The exercise apparatuses may include an adjustment mechanism that allows for adjustment of the fixed orientation between the first and second arms. The fixed orientation may be adjustable through an angle $\alpha$ or $\beta$ (e.g., of about 0-180 degrees or preferably about 0-90 degrees in some embodiments). A suitable adjustment mechanism may include a slotted plate and a retractable pin for adjustably coupling the first and second arms at the fixed orientation.

The floating pulley typically engages the cable at a position between the fixed pulley and the second arm and is movable about the common rotational axis. The fixed pulley typically is stationary about the common rotational axis. The fixed pulley may be mounted to a frame or preferably may be mounted to a third arm that is configured for mounting the apparatus to a frame and which alternatively may be referred to as a mounting arm. The mounting arm may be linear or may be angled in shape having a first end that is positioned at an angle relative to the other end at an elbow joint. In some embodiments, the apparatus may be adjustably mounted to a frame via a mounting arm which rotates in an arcuate path about a mounting axis of rotation. In some embodiments, the disclosed machines and apparatuses may include a mounting plate and a retractable pin for adjusting the mounting arm about a mounting axis of rotation.

Also disclosed are exercise machines that may include: (a) a frame; (b) a seat for a user mounted to the frame; and (c) at least one exercise apparatus as disclosed herein mounted to the frame. Optionally, the disclosed apparatus may be adjustably mounted to the frame via a mounting arm. Optionally, the disclosed machines or apparatuses may be configured for converging and diverging motion. Preferably, the disclosed exercise machines are configured such that the user can perform pushing exercises and pulling exercises without having to change seating orientation on the machine (e.g., where the user sits facing forward throughout). The disclosed exercise machines also may be configured for performing upper body exercises, torso exercises, lower body exercises, or combinations thereof with the user having to change seating orientation on the machine. In some embodiments, the machines include two or more exercise apparatuses as disclosed herein, which optionally may move independently. The exercise machine may be configured for performing pushing exercises and pulling exercises for the upper body, the torso, and the lower body, without the user having to change seating orientation on the machine. In some embodiments, the exercise machine may be configured for performing a combination of exercises without the user having to change seating orientation on the machine (e.g., a chest press, a shoulder press (e.g., a military press), a lateral pull, a low row, a leg press, a leg extension, and a leg curl).

DETAILED DESCRIPTION

Figure 1:
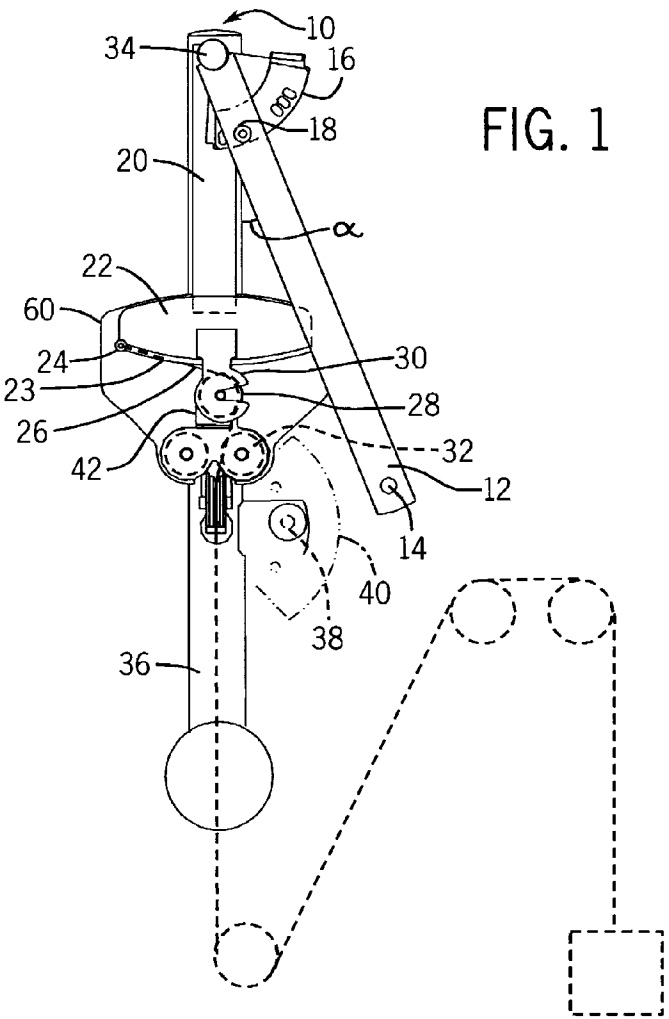
FIG. 1 shows a side view of one embodiment of an exercise apparatus having a work arm adjusted to a proximal position relative to a cam arm at an angle $\alpha$.

Referring now to the figures, FIG. 1 shows a side view of one embodiment of an exercise apparatus 10 as disclosed herein. The apparatus 10 includes a first arm 12, which alternatively may be referred to as a work arm (or a press arm), and a second arm 20, which alternatively may be referred to as a cam arm. The work arm and cam arm rotate about a common rotational axis which may be defined by a pivot pin 34. The work arm includes a grip 14 (alternatively referred to as a handle, contact, or user interface point) which preferably is oriented transversely to the work arm, for moving the arm rotationally forward or rotationally backward and which may be configured for contact by a user (e.g., by a user's hand or by a user's foot). In FIG. 1, the work arm is adjusted to a proximal position relative to the cam arm 20 via a slotted plate 16 and a retractable pin 18 at an angle α. The cam arm includes a cam 22 which is located distal to the rotational axis and preferably includes a curvilinear bottom surface 23. The cable of a pulley system 26 is coupled to the cam arm at a termination point 24 which preferably is located at an end or corner of the cam 22. The cam arm includes an engaging device 30 for engaging a floating pulley 28 which device is located at a position that is distal to the rotational axis 34. The apparatus includes a third arm 36 for mounting the apparatus on an exercise machine which alternatively may be called a mounting arm. The mounting arm 36 is rotationally adjustable via a mounting plate 40 and a retractable pin 38 which may be positioned on an upright portion of a frame for an exercise machine. A fixed pulley 32 and docking device 42 are mounted on the mounting arm. The floating pulley 28 is positioned in the docking device 42 and in the engaging device 30 of the cam arm 20. When the exercises apparatuses disclosed herein are utilized, the floating pulley 28 will be positioned in the docking device 42, the engaging device 30, or in both of the docking device 42 and in the engaging device 30 as shown in FIG. 1.

Figure 2:
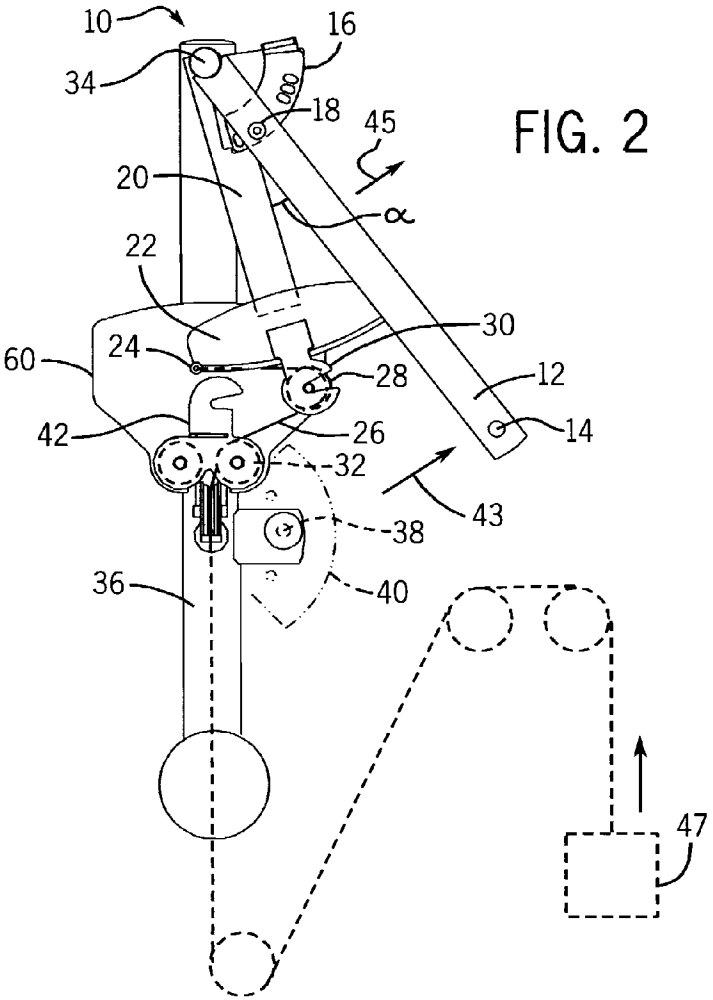
FIG. 2 shows a side view of the exercise apparatus of FIG. 1 after the work arm and cam arm have been rotated in one direction about a rotational axis.
Figure 3:
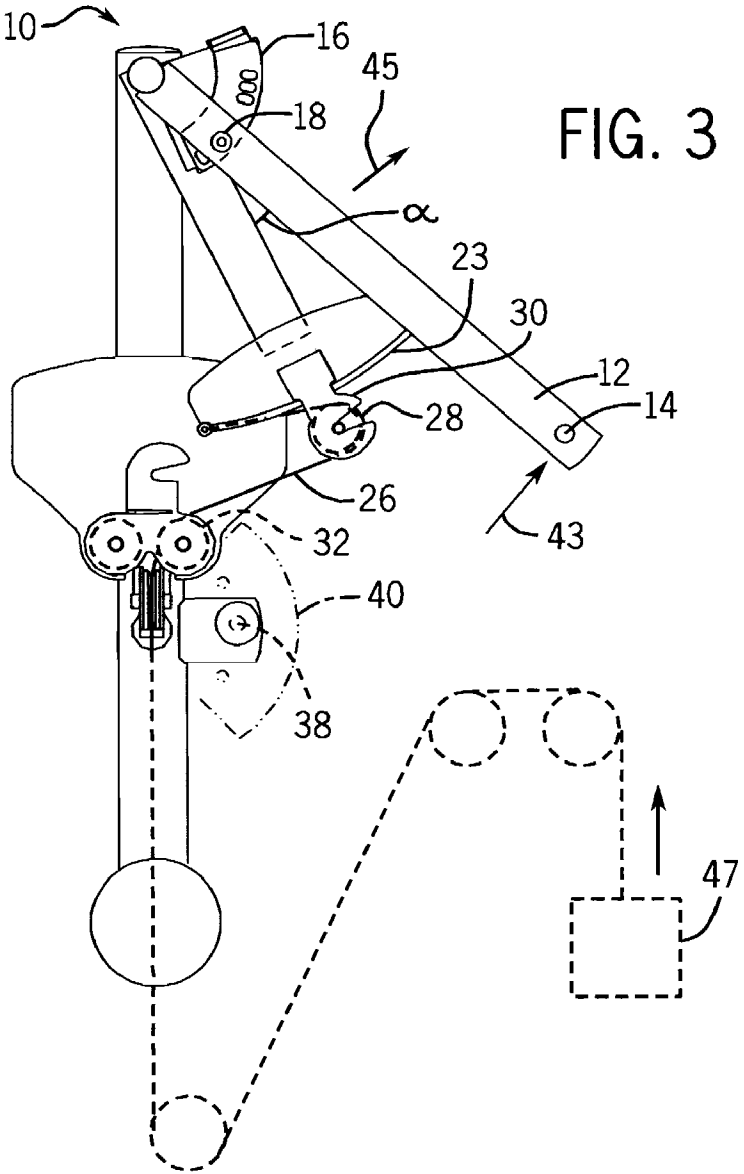
FIG. 3 shows a side view of the exercise apparatus of FIGS. 1 and 2 after the work arm and cam arm have been rotated further in one direction about the rotational axis.

FIG. 2 shows a side view of the exercise apparatus of FIG. 1 after the work arm 12 and cam arm 20 have been rotated in a forward rotational direction about an axis as indicated by the provided arrows 43, 45. As the work arm 12 and cam arm 20 are rotated in the forward rotational direction, the cam arm 20 engages the floating pulley 28 about its axle via the engaging device 30 and removes the pulley from the docking device 42. The cam arm 20 pulls the cable 26 against the resistance mechanism 47 (e.g., a weight stack) which thereby is raised. FIG. 3 shows a side view of the exercise apparatus of FIGS. 1 and 2 after the work arm and cam arm have been rotated further in the forward rotational direction.

Figure 5:
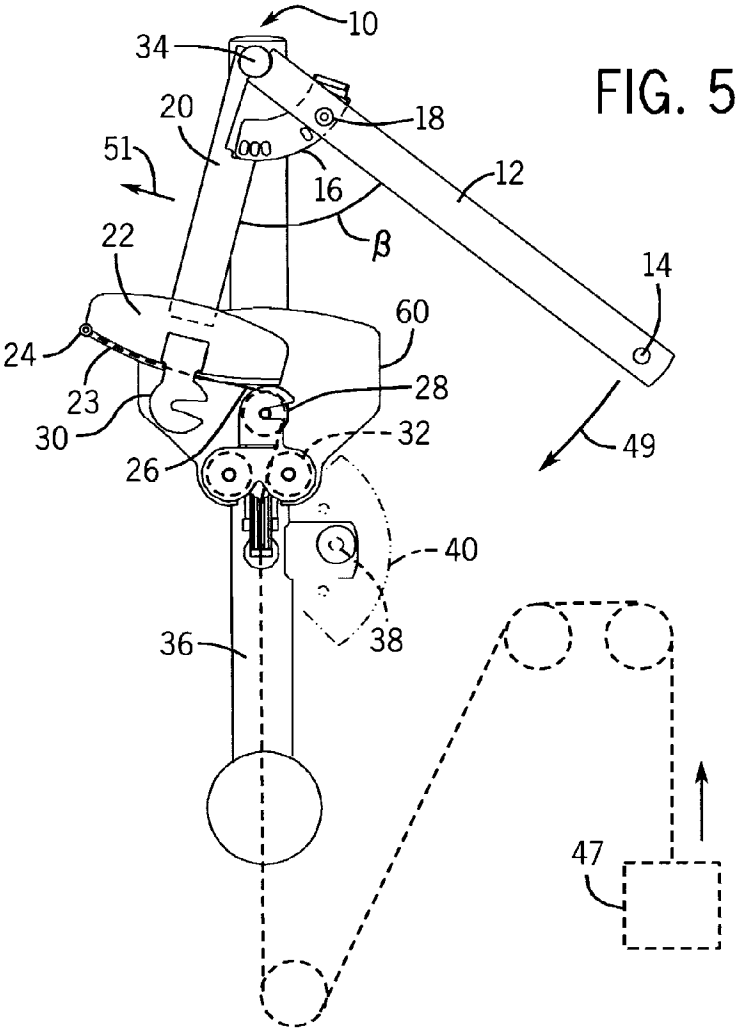
FIG. 5 shows a side view of the exercise apparatus of FIG. 4 after the work arm and cam arm have been rotated in one direction about a rotational axis.
Figure 4:
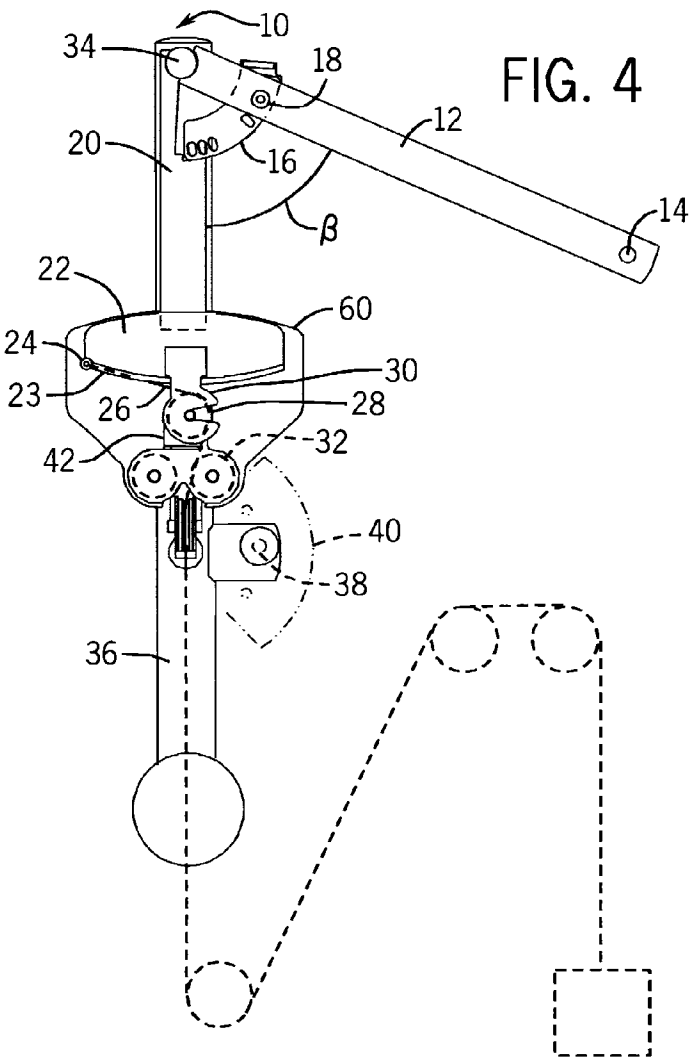
FIG. 4 shows a side view of one embodiment of an exercise apparatus having a work arm adjusted to a distal position relative to a cam arm at an angle $\beta$.
Figure 6:
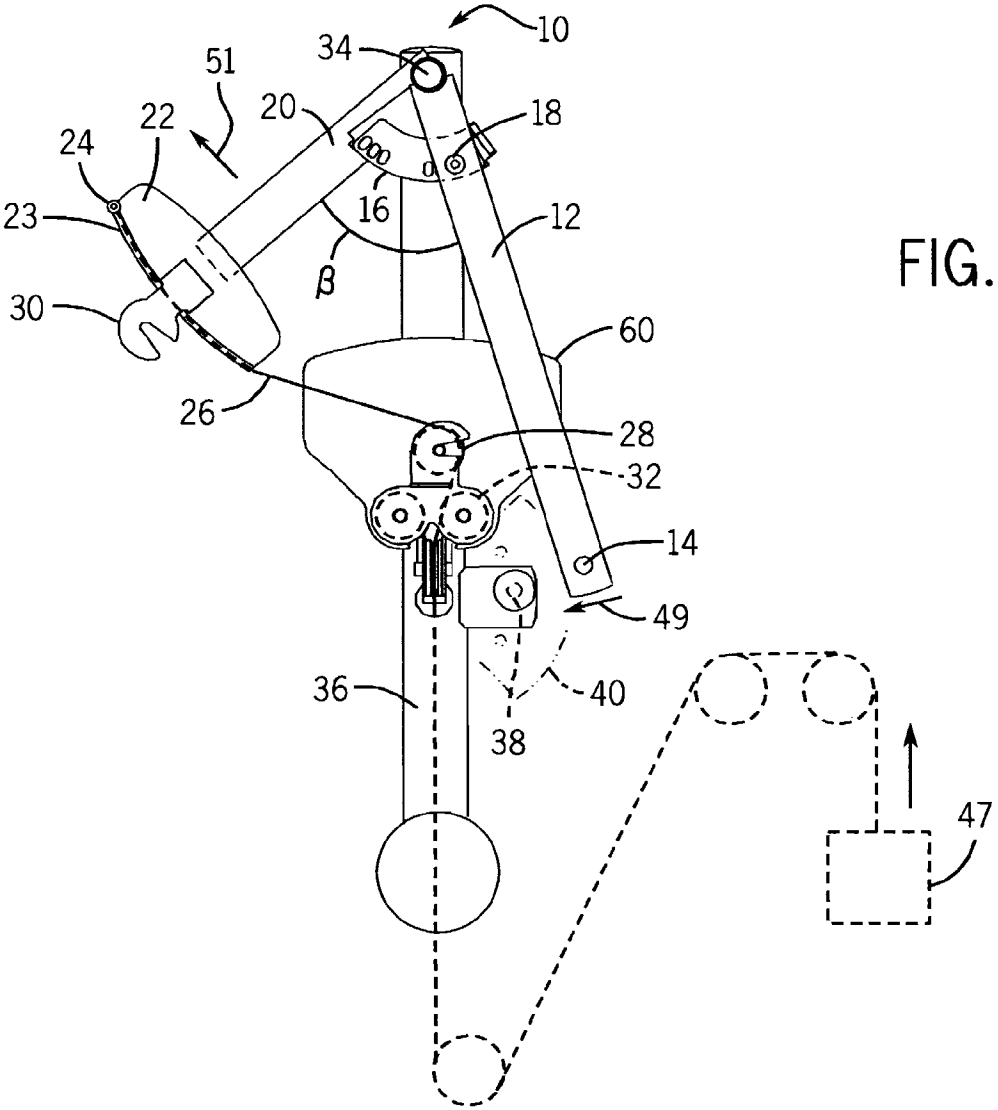
FIG. 6 shows a side view of the exercise apparatus of FIGS. 4 and 5 after the work arm and cam arm have been rotated further in one direction about the rotational axis.

FIG. 4 shows a side view of another embodiment of an exercise apparatus as disclosed herein, for example as in FIG. 1. However, in FIG. 4 the work arm 12 is adjusted to a distal position relative to the cam arm 20 via the slotted plate 16 and the retractable pin 18 at an angle β. FIG. 5 shows a side view of the exercise apparatus of FIG. 4 after the work arm 12 and cam arm 20 have been rotated in a rearward rotational direction about an axis as indicated by the provided arrows 49,51. As the work arm 12 and cam arm 20 are rotated in the rearward rotational direction, the cam arm 20 disengages the floating pulley 28 and the floating pulley 28 remains docked in the docking device 42 about its axle. Further, as the work arm 12 and cam arm 20 are rotated in the rearward rotational direction, the cable 26 contacts the curvilinear bottom surface 23 of the cam 22. The cam arm 20 pulls the cable 26 against the resistance mechanism 47 (e.g., a weight stack) which thereby is raised. FIG. 6 shows a side view of the exercise apparatus of FIGS. 4 and 5 after the work arm and cam arm have been rotated further in one direction about a rotational axis.

Figure 7:
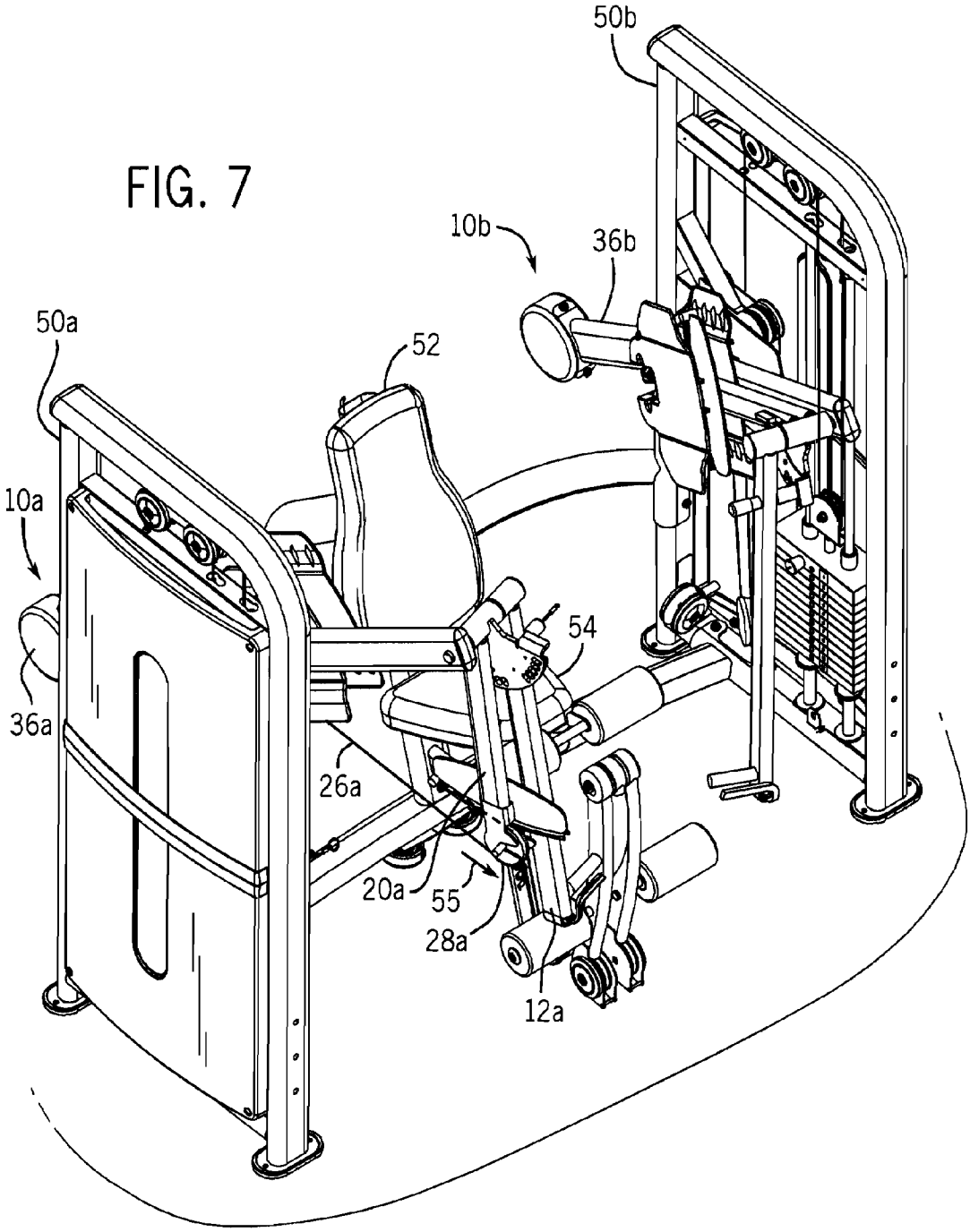
FIG. 7 shows a perspective view of one embodiment of an exercise machine as disclosed herein.

FIG. 7 shows a perspective view of one embodiment of an exercise machine as disclosed herein. The exercise machine includes two exercise apparatuses 10*a*, 10*b* that preferably can move independently. The exercise machine includes a frame having upright portions 50*a*, 50*b* to which the exercises apparatuses 10*a*, 10*b* are mounted. The exercise machine also includes a seat mounted to the frame and having a back portion 52 and a seat portion 54. As indicated in FIG. 7, the work arm 12*a* and cam arm 20*a* of the exercise apparatus on the right of the machine 10*a* have been moved to a forward rotational direction relative to the exercise seat as indicated by the forward pointing arrow 55. The cam arm 20*a* of the exercise apparatus on the right of the machine has engaged the floating pulley 28*a* and has pulled the cable 26*a* forward.

Figure 8:
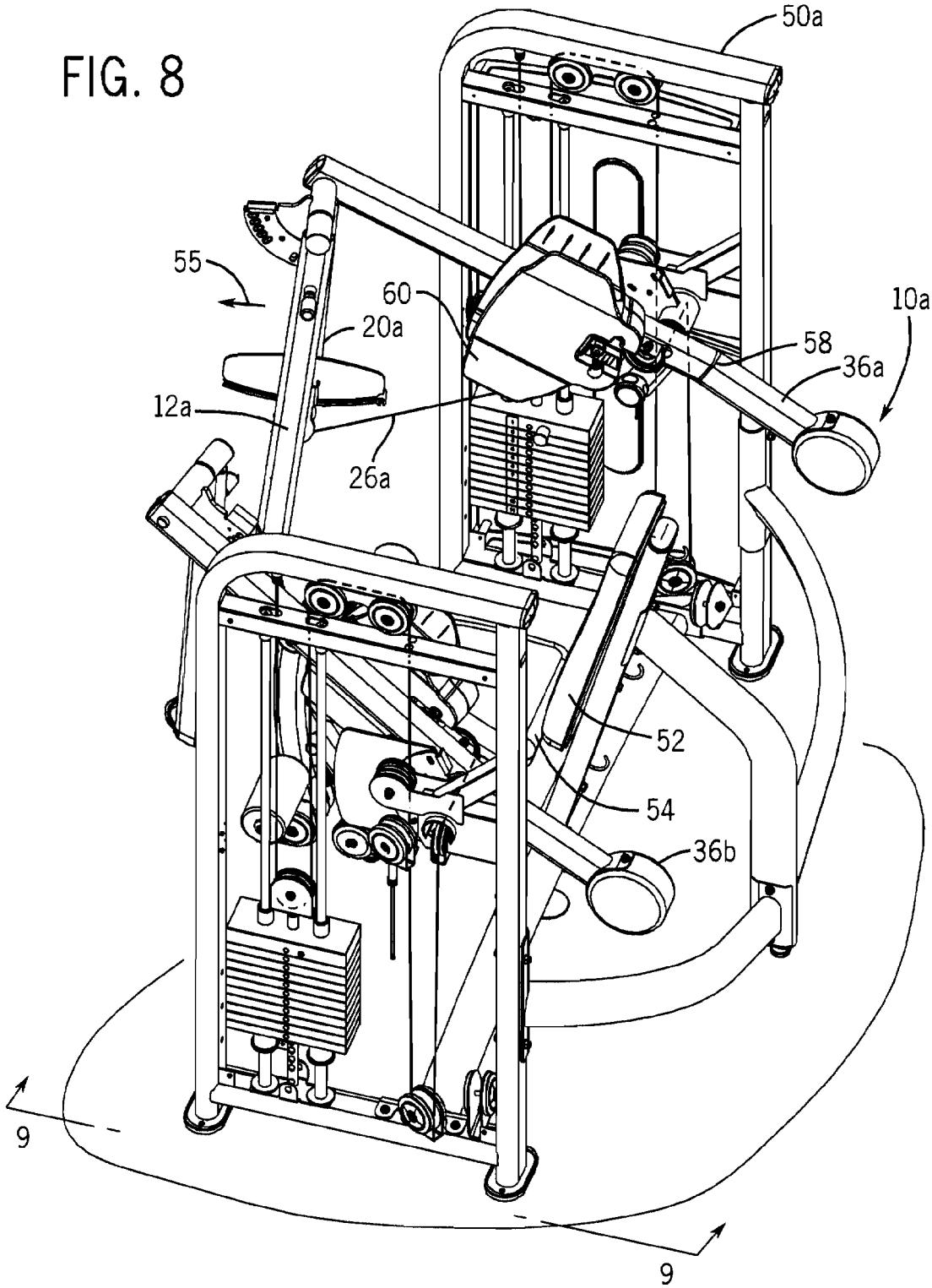
FIG. 8 shows a perspective view of one embodiment of an exercise machine as disclosed herein comprising two exercise apparatuses and displaying forward rotational direction of motion of the work arm and cam arm of one of the apparatuses relative to a seat.

FIG. 8 shows another perspective view of the exercise machine of FIG. 7 with the cam arm 20*a* of the exercise apparatus on the right of the machine having engaged the floating pulley 28*a* and having pulled the cable 26*a* forward. The mounting arms 36*a*, 36*b* are shown as being angular in shape and having a first end that is positioned at an angle relative to the other end at an elbow joint 58, which configuration may permit converging and diverging motion for the working arm of the apparatus towards or away from a sagittal plane that bisects the user.

Figure 9:
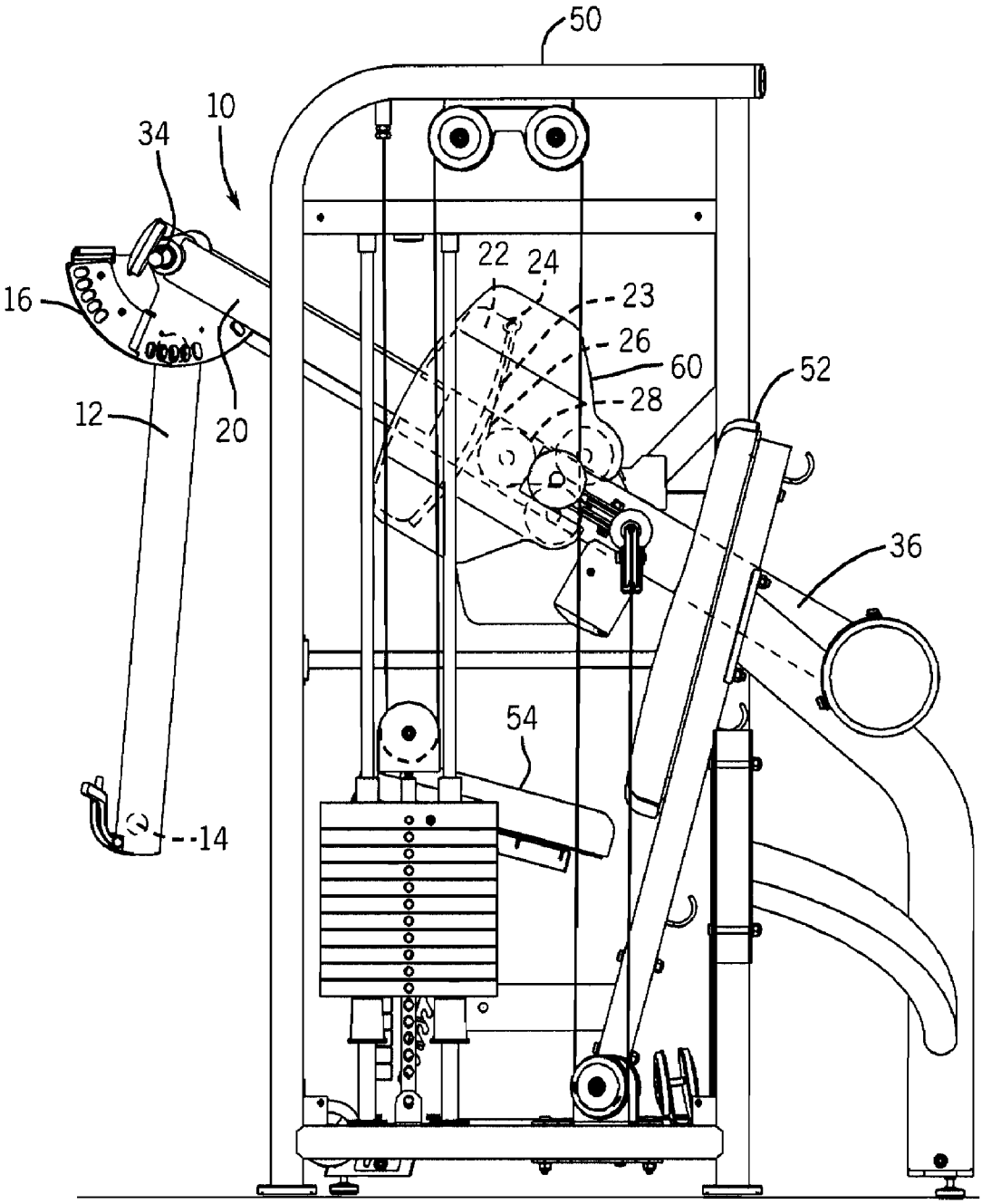
FIG. 9 shows a side view along line 9-9 of FIG. 8.

FIG. 9 shows a side view taken along line 9-9 of FIG. 8 of an exercise machine that includes an exercise apparatus 10 mounted to an upright portion of a frame 50 of the exercise machine. The work arm 12 is adjusted to an intermediate position relative to the cam arm 20. In some embodiments, this positioning may be suitable for a user performing a leg press exercise.

Figure 10:
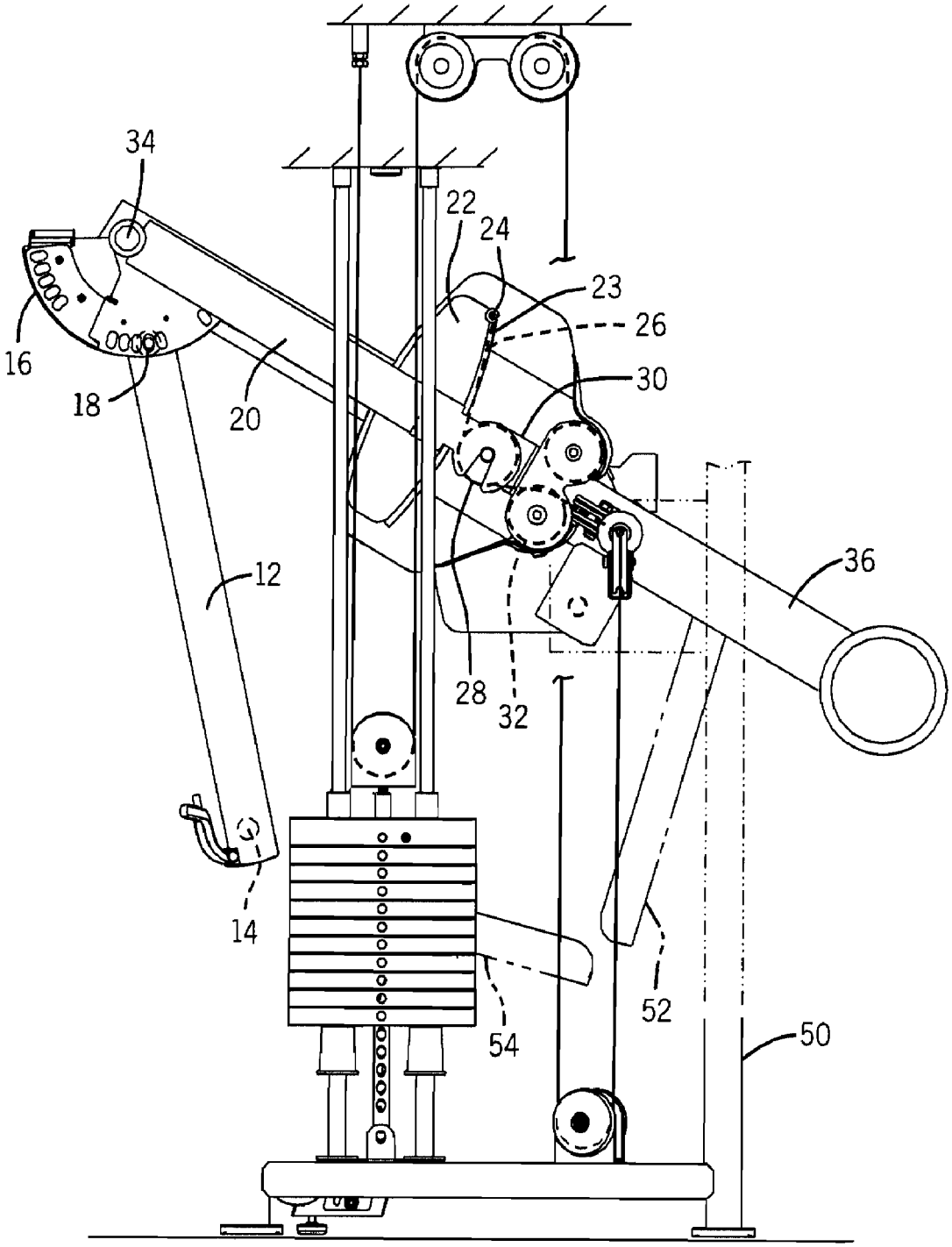
FIG. 10 shows a partial sectional view of an exercise machine comprising an exercise apparatus as disclosed herein.
Figure 11:
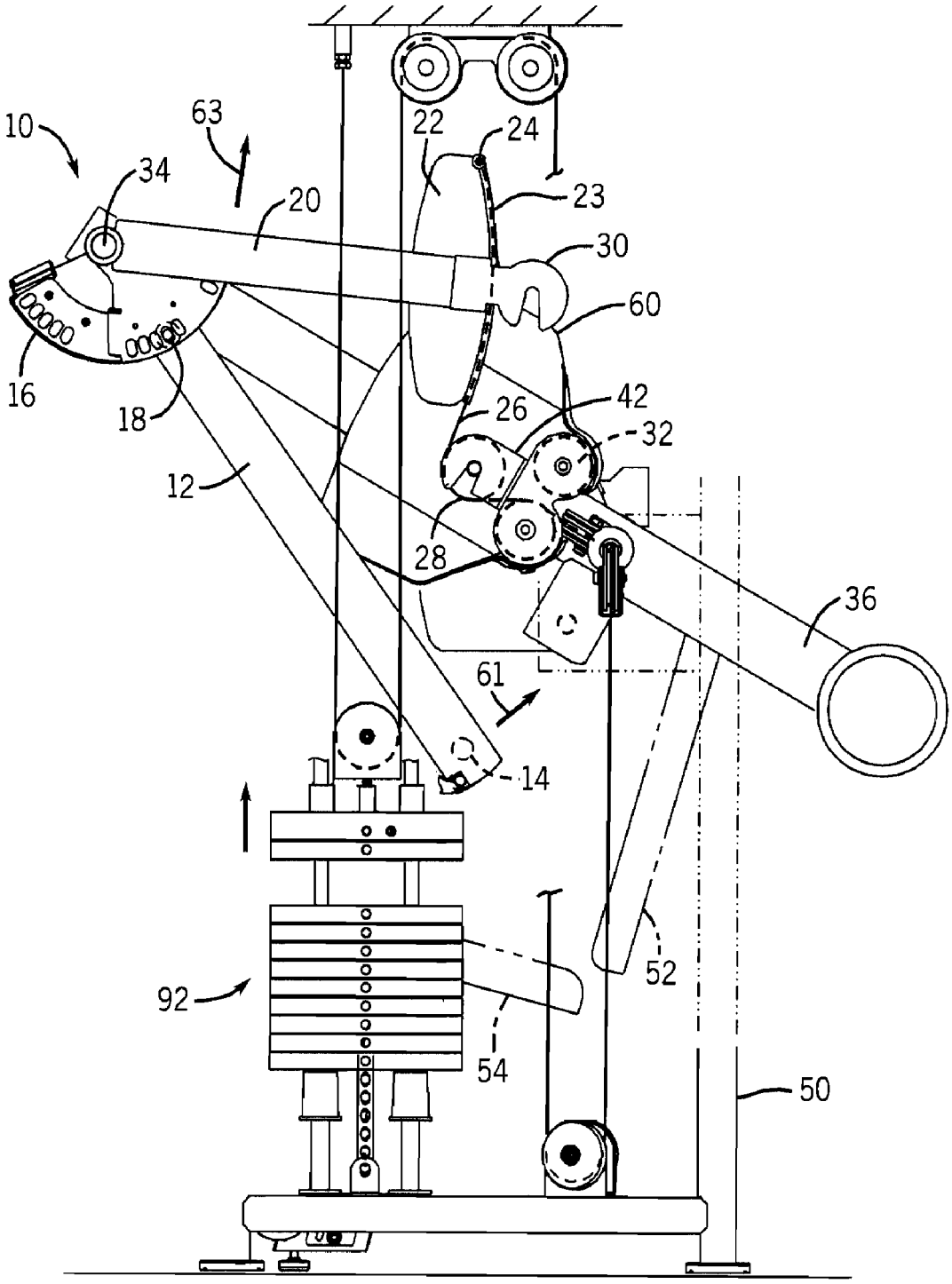
FIG. 11 shows a partial sectional view of the exercise machine of FIG. 10 after the work arm and cam arm have been rotated in a rearward rotational direction relative to a seat.

FIG. 10 shows a partial sectional view of an exercise machine that includes an exercise apparatus 10 mounted to an upright portion of a frame 50. The work arm 12 is adjusted to a more proximal position relative to the cam arm 20 in comparison to the positioning shown in FIG. 9. This positioning may be suitable for a user performing a low row. FIG. 11 shows a partial sectional view of the exercise machine of FIG.

10 after the work arm 12 and cam arm 20 have been rotated in a rearward rotational direction relative to the seat 52 as indicated by the provided arrows 61, 63, thus pulling the cable 26 which contacts the curvilinear bottom face 23 of the cam 22 and raises the weight stack 92.

Figure 12:
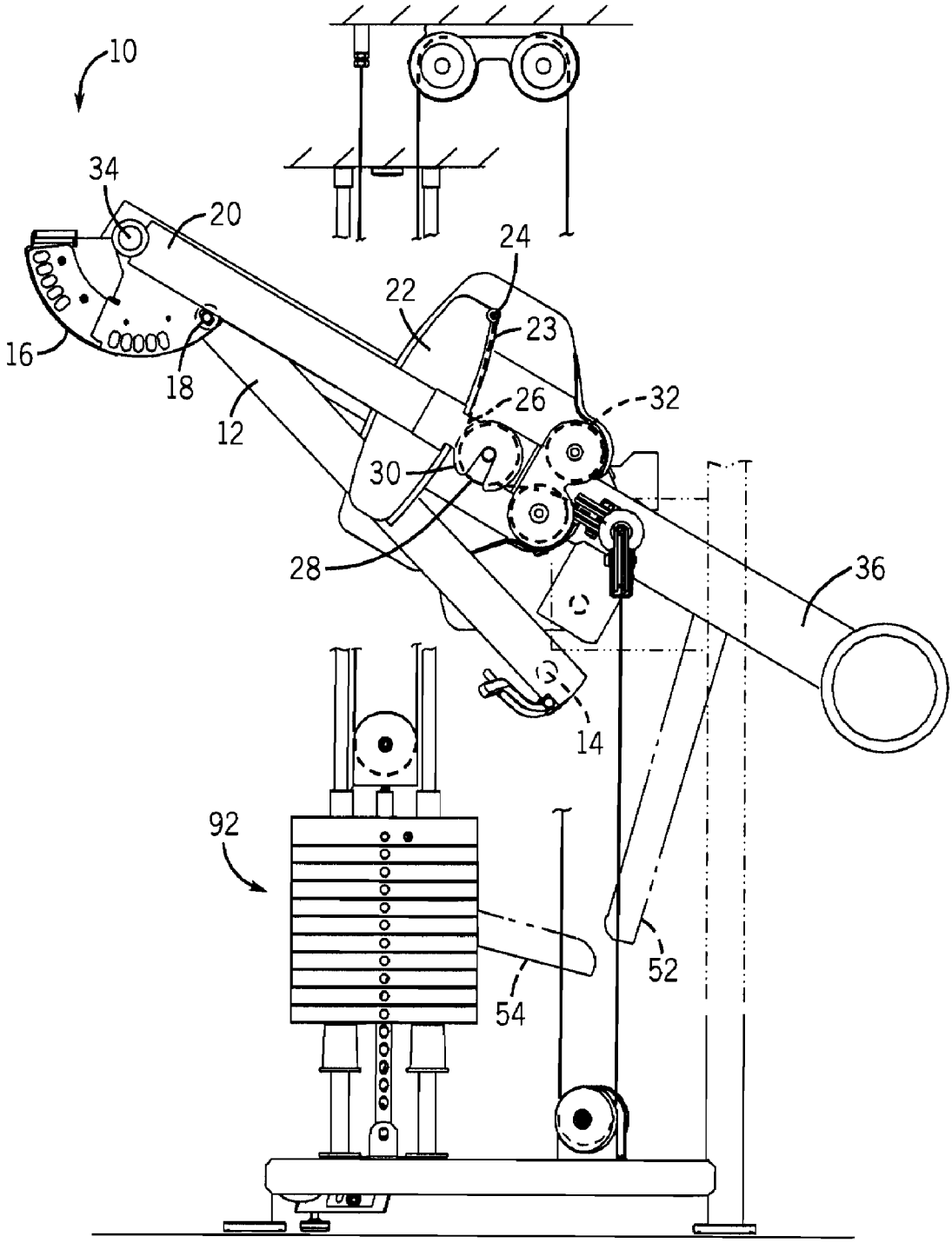
FIG. 12 shows a partial sectional view of an exercise machine having a work arm adjusted to a proximal position relative to a cam arm.
Figure 13:
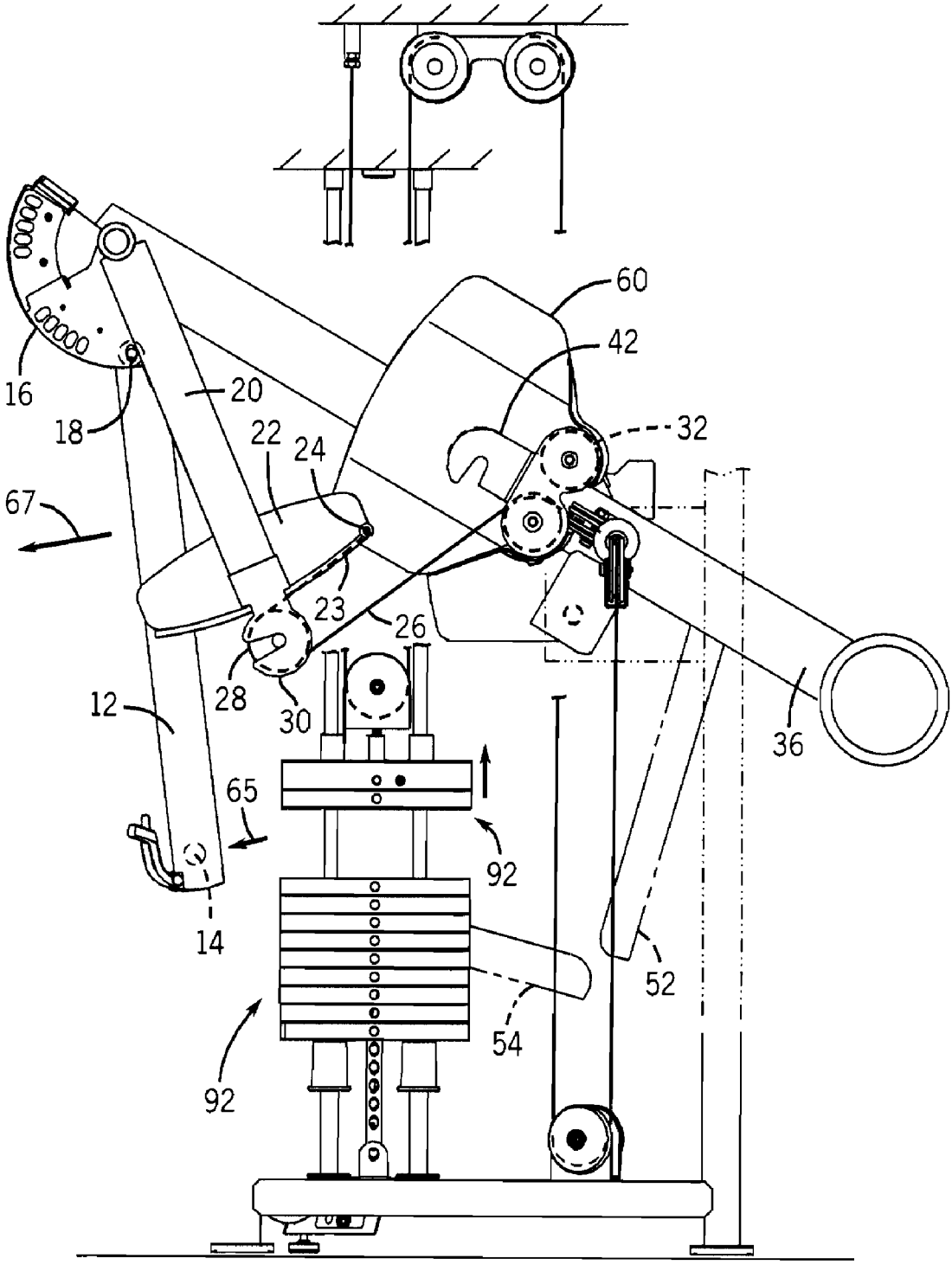
FIG. 13 shows a partial sectional view of the exercise apparatus of FIG. 12 after the work arm and cam arm have been rotated in a forward rotational direction relative to a seat.

FIG. 12 shows a partial sectional view of an exercise machine having a work arm 12 adjusted to a proximal position relative to a cam arm 20. This positioning may be suitable for a user performing a decline press. FIG. 13 shows a partial sectional view of the exercise apparatus of FIG. 12 after the work arm 12 and cam arm 20 have been rotated in a forward rotational direction relative to the seat 52 as indicated by the provided arrows 65, 67. The cam arm 20 has engaged the floating pulley 28 via the engaging device 30 at the floating pulley axle and has removed the floating pulley 28 from the docking device 42, thereby pulling the cable 26 forward and raising the weight stack 92.

Figure 14:
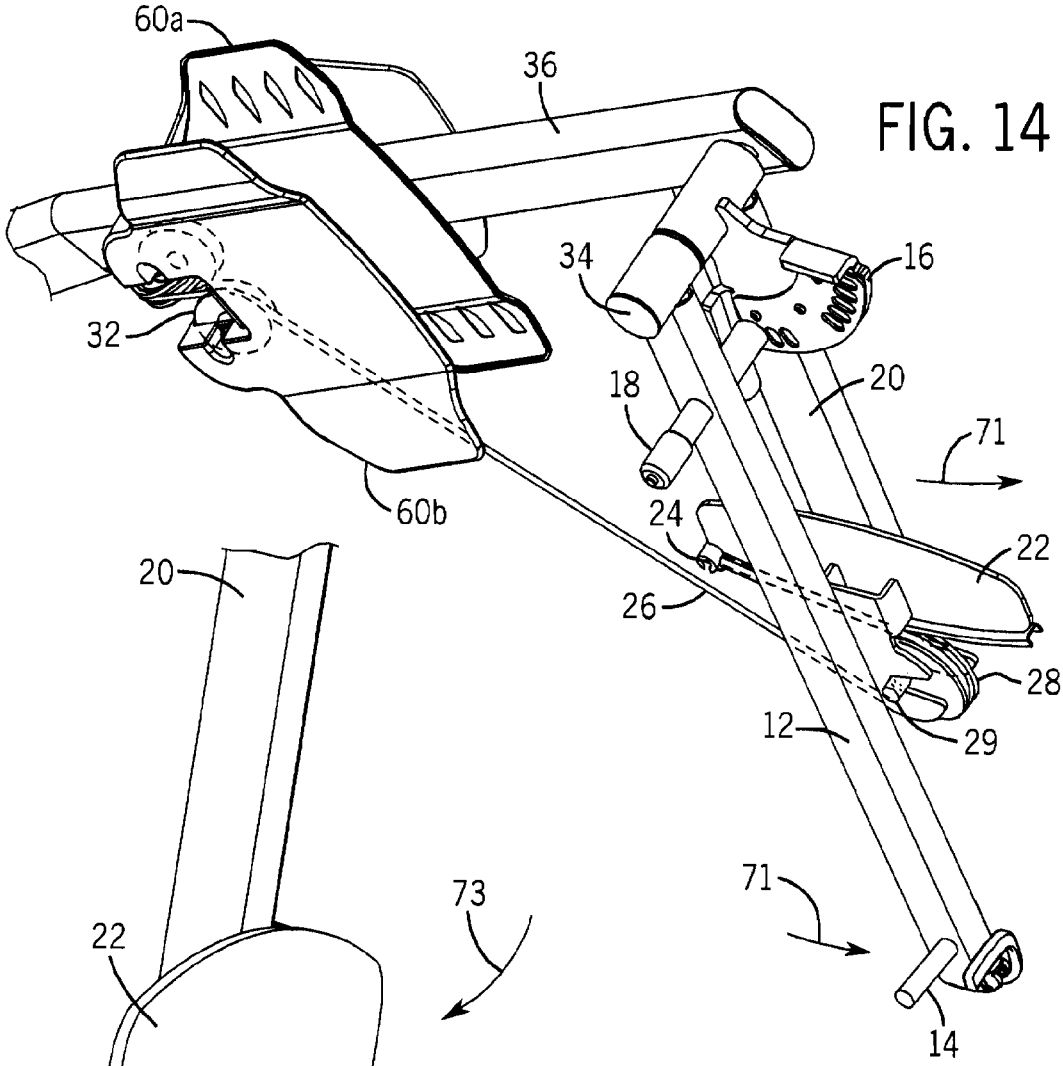
FIG. 14 shows a perspective view of an exercise apparatus as disclosed herein and indicating a direction of motion whereby the cam arm engages the floating pulley.

FIG. 14 shows a partial perspective view of an exercise apparatus as disclosed herein and indicating a direction of motion 71 whereby the cam arm 20 has engaged the floating pulley 28 via the engaging device 30 at the floating pulley axle 29 and pulled the cable 26 forward. The cam 22 and the engaging device 30 pass between the cover plates 60*a*, 60*b* as the work arm 12 and the cam arm 20 are moved forwardly or backwardly in a rotational direction.

Figure 15:
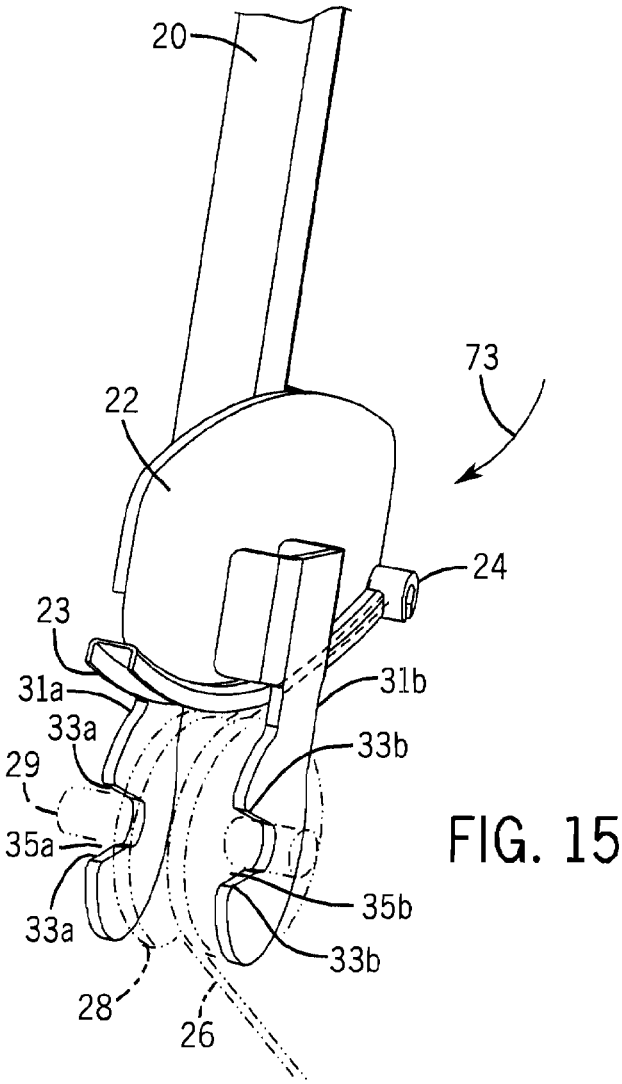
FIG. 15 shows a partial perspective view of a cam arm of an exercise apparatus having engaged the floating pulley as disclosed herein.

FIG. 15 shows a partial perspective view of a cam arm 20 of an exercise apparatus having engaged the floating pulley 28 via the engaging device 30. In FIG. 15, the engaging device includes a pair of brackets 31*a*, 31*b* having pairs of teeth 33*a*, 33*b* on a forward side with a gap therebetween 35*a*,35*b* for engaging the floating pulley 28 at the floating pulley axle 29 and removing the floating pulley from the docking device 42 when the engaging device 30 is moved in a forward rotational direction 73.

Figure 16:
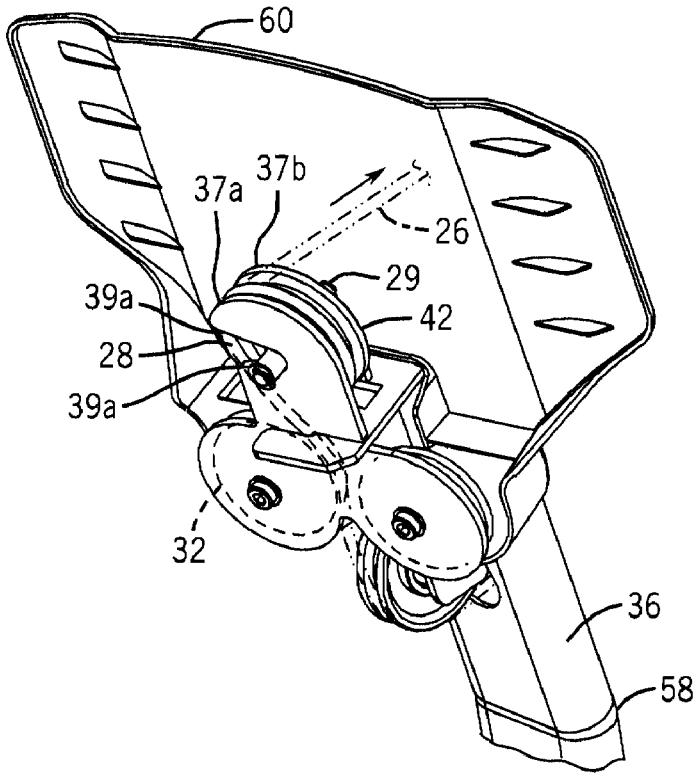
FIG. 16 shows a partial perspective view of a mounting arm of an exercise apparatus as disclosed herein.

FIG. 16 shows a partial perspective view of a mounting arm 36 of an exercise apparatus as disclosed herein. A docking device 42 is mounted on the mounting arm 36 and includes a pair of brackets 37*a*, 37*b* having pairs of teeth 39*a*, 39*b* (not shown) on a forward side with a gap therebetween for docking the floating pulley 28 at the floating pulley axle 29. A system of fixed pulleys 32 also are mounted on the mounting arm 36. The mounting arm 36 further may include a cover plate 60 for the docking device 42 and system of fixed pulleys 32. In some embodiments, the brackets of the engaging device 30 (FIGS. 14 and 15) may pass outside of the brackets for the docking device to engage the axle of the floating pulley and remove the floating pulley from the docking device when the engaging device 30 is moved in a forward direction.

Figure 17:
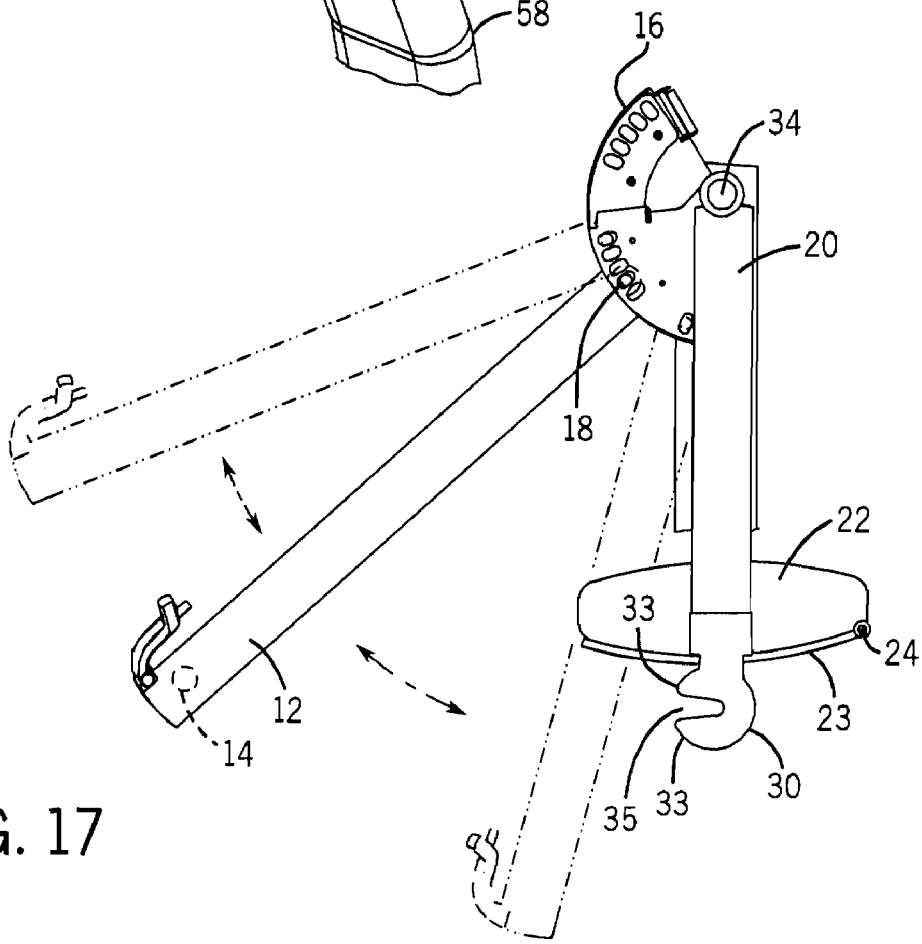
FIG. 17 shows a partial perspective view of an exercise apparatus as disclosed herein an indicating adjustable positions for a work arm relative to a cam arm.

FIG. 17 shows a partial perspective view of an exercise apparatus as disclosed herein and indicating adjustable positions for the work arm 12 relative to the cam arm 20. The work arm 12 is adjustable via a slotted plate 16 and a retractable pin 18.

Figure 18:
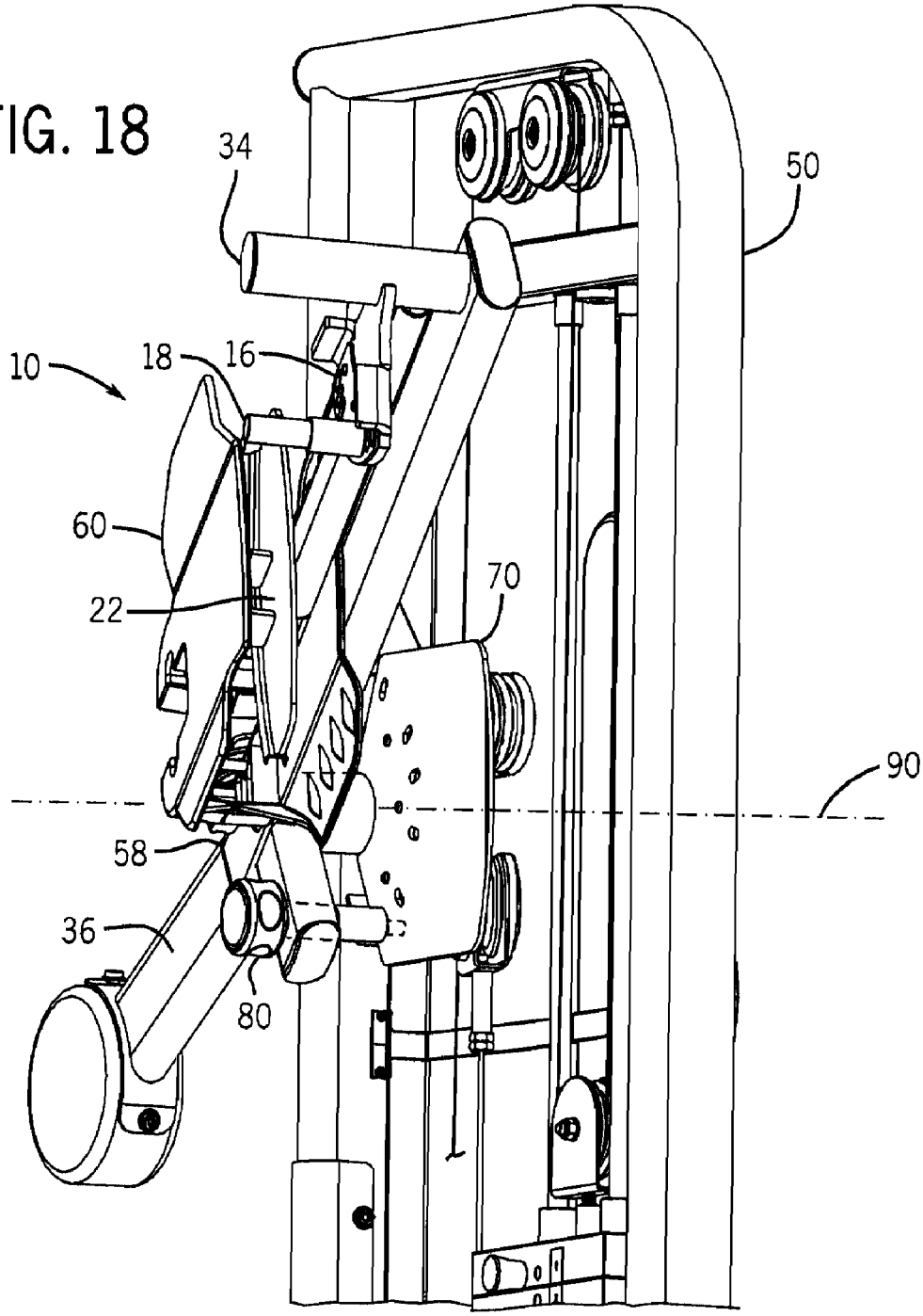
FIG. 18 shows a partial perspective view of an exercise apparatus as disclosed herein mounted on a frame via a mounting arm.

FIG. 18 shows a perspective view of an exercise apparatus as disclosed herein mounted on an upright portion of a frame 50 via a mounting arm 36. The mounting arm 36 is adjustably rotational in an arc about a mounting axis 90 via a slotted mounting plate 70 and retractable pin 80. The mounting axis 90 is approximately perpendicular to an upright portion of the frame 50. The mounting arm is angled and includes a first end positioned at an angle relative to the other end at an elbow joint 58. The rotational axis defined by the pivot pin 34 is at an angle relative to the rotational mounting axis 90, providing for converging and diverging motion for the working arm of the exercise apparatus towards or away from a sagittal plane that bisects the user.

The disclosed exercise machines may be multifunctional and configured for performing multiple exercises at a single setting. In some embodiments, the exercise machine may be configured at a single setting for performing one or more of: a shoulder press when the working arm is pushed and a lateral pull down when the working arm is pulled; a super incline press when the working arm is pushed and a super high row when the working arm is pulled; an incline press when the working arm is pushed and a high row when the working arm is pulled; a chest press when the working arm is pushed and a row when the working arm is pulled; a decline press when the working arm is pushed and a low row when the working arm is pulled.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems and method steps described herein may be used alone or in combination with other configurations, systems and method steps. It is to be expected that various equivalents, alternatives and modifications are possible.

The invention claimed is:

1. Exercise apparatus comprising:

first and second arms that rotate about a common rotational axis, the first and second arms having a fixed orientation with respect to each other;

a resistance mechanism;

a fixed pulley;

a cable extending through the fixed pulley and coupling the second arm to the resistance mechanism; and a floating pulley engaging the cable;

a docking device for docking the floating pulley; and an engaging device that is coupled to the second arm at a location distal from the rotational axis;

wherein as the first and second arms are rotated about the rotational axis in one direction, the engaging device engages the floating pulley about its axle and removes the floating pulley from the docking device, and the second arm pulls the cable against the resistance mechanism; and wherein as the first and second arms are rotated about the rotational axis in the opposite direction the docking device docks the floating pulley about its axle and the second arm pulls the cable against the resistance mechanism.

2. The apparatus according to claim 1, further comprising an adjustment mechanism that allows for adjustment of the fixed orientation between the first and second arms.

3. The apparatus according to claim 2, wherein the adjustment mechanism comprises a slotted plate and a retractable pin for coupling the first and second arms.

4. The apparatus according to claim 1, wherein the floating pulley engages the cable at a location that is between the fixed pulley and the second arm.

5. The apparatus according to claim 1, wherein the resistance mechanism comprises a weight stack.

6. The apparatus according to claim 1, comprising a mounting arm, wherein the docking device is fixed to the mounting arm.

7. An exercise machine comprising:

(a) a frame;

(b) a seat for a user mounted to the frame; and (c) at least one exercise apparatus according to claim 6 mounted to the frame and configured for converging and diverging motion;

wherein the machine is configured such that the user can perform pushing exercises and pulling exercises without having to change seating orientation on the machine.

8. The machine according to claim 7, wherein the apparatus is adjustably mounted to the frame via the mounting arm about a mounting axis of rotation that is approximately perpendicular to an upright arm of the frame.

9. The machine according to claim 7, further comprising a mounting plate and a retractable pin for adjusting the mounting arm.

10. The machine according to claim 7, configured for performing upper body exercises, torso exercises, lower body exercises, or combinations thereof.

11. An exercise machine comprising:

(a) a frame;

(b) a seat for a user mounted to the frame; and (c) at least one exercise apparatus according to claim 1 mounted to the frame and configured for converging and diverging motion;

wherein the machine is configured such that the user can perform pushing exercises and pulling exercises without having to change seating orientation on the machine.

12. The machine according to claim 11, wherein the apparatus is adjustably mounted to the frame.

13. The machine according to claim 11, configured for performing upper body exercises, torso exercises, lower body exercises, or combinations thereof.

14. The apparatus according to claim 1, wherein the docking device comprises a pair of brackets comprising a pair of teeth on a forward side with a gap therebetween for docking the floating pulley at the floating pulley axle, and the engaging device comprises a pair of brackets comprising a pair of teeth on a forward side with a gap therebetween for engaging the floating pulley at the floating pulley axle and removing the floating pulley from the docking device when the engaging device is moved in a forward rotational direction.

15. An exercise machine comprising:

(a) a frame;

(b) a seat for a user mounted to the frame; and (c) at least two exercises apparatuses mounted to the frame, each of the two exercise apparatuses comprising:

first and second arms that rotate about a common rotational axis, the first and second arms having a fixed orientation with respect to each other;

a resistance mechanism;

a fixed pulley;

a cable extending through the fixed pulley and coupling the second arm to the resistance mechanism; and a floating pulley engaging the cable;

a docking device for docking the floating pulley; and an engaging device that is coupled to the second arm at a location distal from the rotational axis;

wherein as the first and second arms are rotated about the rotational axis in one direction, the engaging device engages the floating pulley about its axle and removes the floating pulley from the docking device, and the second arm pulls the cable against the resistance mechanism; and wherein as the first and second arms are rotated about the rotational axis in the opposite direction the docking device docks the floating pulley about its axle and the second arm pulls the cable against the resistance mechanism.

16. The machine according to claim 15, configured such that the user can perform pushing exercises and pulling exercises without having to change seating orientation on the machine.

17. The machine according to claim 15, configured for performing upper body exercises, torso exercises, lower body exercises, or combinations thereof without having to change seating orientation on the machine.

18. The machine according to claim 15, wherein the docking device comprises a pair of brackets comprising a pair of teeth on a forward side with a gap therebetween for docking the floating pulley at the floating pulley axle, and the engaging device comprises a pair of brackets comprising a pair of teeth on a forward side with a gap therebetween for engaging the floating pulley at the floating pulley axle and removing the floating pulley from the docking device when the engaging device is moved in a forward rotational direction.

19. An exercise machine comprising:

(a) a frame;

(b) a seat for a user mounted to the frame;

(c) and at least two exercises apparatuses mounted to the frame via mounting arms that are adjustably rotatable about a mounting axis, each of the two exercise apparatuses configured for converging and diverging motion and comprising:

first and second arms that rotate about a common rotational axis, the first and second arms having a fixed orientation with respect to each other;

a resistance mechanism;

a fixed pulley;

a cable extending through the fixed pulley and coupling the second arm to the resistance mechanism; and a floating pulley engaging the cable;

a docking device for docking the floating pulley; and an engaging device that is coupled to the second arm at a location distal from the rotational axis;

wherein as the first and second arms are rotated about the rotational axis in one direction, the engaging device engages the floating pulley about its axle and removes the floating pulley from the docking device, and the second arm pulls the cable against the resistance mechanism; and wherein as the first and second arms are rotated about the rotational axis in the opposite direction the docking device docks the floating pulley about its axle and the second arm pulls the cable against the resistance mechanism.

20. The machine according to claim 19, configured such that the user can perform pushing exercises and pulling exercises without having to change seating orientation on the machine.

21. The machine according to claim 19, configured for performing upper body exercises, torso exercises, lower body exercises, or combinations thereof without having to change seating orientation on the machine.

22. The machine according to claim 19, configured for performing one or more of a chest press, a shoulder press, a lateral pull, a low row, a leg press, a leg extension, and a leg curl.

23. The machine according to claim 19, wherein the first arm is a working arm and the machine is configured at a single setting for performing a shoulder press when the working arm is pushed and a lateral pull down when the working arm is pulled.

24. The machine according to claim 19, wherein the first arm is a working arm and the machine is configured at a single setting for performing a chest press when the working arm is pushed and a row when the working arm is pulled.

25. The machine according to claim 19, wherein the docking device comprises a pair of brackets comprising a pair of teeth on a forward side with a gap therebetween for docking the floating pulley at the floating pulley axle, and the engaging device comprises a pair of brackets comprising a pair of teeth on a forward side with a gap therebetween for engaging the floating pulley at the floating pulley axle and removing the floating pulley from the docking device when the engaging device is moved in a forward rotational direction.

* * * * *